US010724338B2

(12) United States Patent
Bulekbay et al.

(10) Patent No.: US 10,724,338 B2
(45) **Date of Patent: *Jul. 28, 2020**

(54) RAPIDLY COOLING A GEOLOGIC FORMATION IN WHICH A WELLBORE IS FORMED

(71) Applicant: Saudi Arabian Oil Company, Dhahran (SA)

(72) Inventors: Aslan Bulekbay, Udhailiyah (SA); Abdulkareem Harbi, Udhailiyah (SA); Abdullah Khamees, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/503,233

(22) Filed: Jul. 3, 2019

(65) Prior Publication Data

US 2019/0323320 A1 Oct. 24, 2019

Related U.S. Application Data

(63) Continuation of application No. 16/059,748, filed on Aug. 9, 2018, now Pat. No. 10,450,839.
(Continued)

(51) Int. Cl.

| | |
|---|---|
| ***E21B 36/00*** | (2006.01) |
| ***E21B 43/26*** | (2006.01) |
| ***E21B 43/16*** | (2006.01) |

(52) U.S. Cl.
CPC ..... *E21B 36/001* (2013.01); *E21B 43/16* (2013.01); *E21B 43/26* (2013.01)

(58) Field of Classification Search
CPC ..... E21B 36/001; E21B 43/16; E21B 43/26
See application file for complete search history.

(56) References Cited

U.S. PATENT DOCUMENTS

| | | | |
|---|---|---|---|
| 3,882,937 | A | 5/1975 | Robinson |
| 4,340,405 | A | 7/1982 | Steyert |

(Continued)

FOREIGN PATENT DOCUMENTS

| | | |
|---|---|---|
| AU | 2013206729 | 4/2015 |
| CN | 102777138 | 1/2016 |

(Continued)

OTHER PUBLICATIONS

International Search Report and Written Opinion issued in International Application No. PCT/US2018/000170 dated Jan. 28, 2019, 14 pages.

(Continued)

*Primary Examiner* — Daniel P Stephenson
(74) *Attorney, Agent, or Firm* — Fish & Richardson P.C.

(57) ABSTRACT

A first chamber is configured to be positioned within a wellbore. The first chamber includes a cooling fluid. A second chamber is positioned uphole of the first chamber. The first chamber and the second chamber are configured to be lowered to a position within the wellbore. The second chamber includes a cold source at a sub-zero temperature. The cooling fluid is configured to be cooled upon contacting the cold source. A separation member is positioned between the first chamber and second chamber. The separation member separates the cooling fluid and the cold source. An activation device is connected to the separation member. The activation device is configured to cause the separation member to allow the cold source to contact the cooling fluid.

4 Claims, 3 Drawing Sheets

Related U.S. Application Data

(60) Provisional application No. 62/545,690, filed on Aug. 15, 2017.

(56) References Cited

U.S. PATENT DOCUMENTS

| | | | | |
|---|---|---|---|---|
| 4,476,932 | A | 10/1984 | Emery | |
| 4,532,992 | A | 8/1985 | Coenen et al. | |
| 4,660,643 | A | 4/1987 | Perkins | |
| 4,705,113 | A | 11/1987 | Perkins | |
| 5,394,942 | A | 3/1995 | Catania | |
| 6,347,675 | B1 | 2/2002 | Kolle | |
| 6,988,552 | B2 | 1/2006 | Wilson et al. | |
| 7,516,787 | B2 | 4/2009 | Kaminsky | |
| 7,647,971 | B2 | 1/2010 | Kaminsky | |
| 7,677,317 | B2 | 3/2010 | Wilson | |
| 8,002,038 | B2 | 8/2011 | Wilson | |
| 8,104,537 | B2 | 1/2012 | Kaminsky | |
| 9,097,094 | B1 | 8/2015 | Frost | |
| 9,328,282 | B2 | 5/2016 | Li | |
| 10,012,054 | B2 | 7/2018 | Ciglenec | |
| 10,450,839 | B2 * | 10/2019 | Bulekbay | E21B 43/16 |
| 10,508,517 | B2 | 12/2019 | Bulekbay et al. | |
| 2005/0097911 | A1 | 5/2005 | Revellat | |
| 2005/0126784 | A1 | 6/2005 | Dalton | |
| 2006/0144619 | A1 | 7/2006 | Storm | |
| 2007/0215355 | A1 | 9/2007 | Shapovalov | |
| 2008/0223579 | A1 | 9/2008 | Goodwin | |
| 2013/0312977 | A1 | 11/2013 | Lembcke | |
| 2015/0047846 | A1 | 2/2015 | Oort | |
| 2018/0230361 | A1 | 8/2018 | Foster | |
| 2018/0328156 | A1 | 11/2018 | Slater | |
| 2019/0055818 | A1 | 2/2019 | Bulekbay | |
| 2019/0323320 | A1 * | 10/2019 | Bulekbay | E21B 43/16 |

FOREIGN PATENT DOCUMENTS

| | | |
|---|---|---|
| WO | 2009018536 | 2/2009 |
| WO | 2017164878 | 9/2017 |

OTHER PUBLICATIONS

International Search Report and Written Opinion issued in International Application No. PCT/US2019/020904 dated May 27, 2019, 14 pages.

Clifton, "Modeling of In-Situ Stress Change Due to Cold Fluid Injection," SPE papers 22107, presented at the International Arctic Technology Conference, May 29-31, 1991, 13 pages.

Gil et al., "Wellbore Cooling as a Means to Permanently Increase Fracture Gradient," SPE Annual Technical Conference and Exhibition, San Antonio, Texas, Sep. 24-27, 2006, published Jan. 1, 2006, 9 pages.

hub.globalccsinstitute.com [online], "2.1 The Properties of CO2," available on or before Oct. 22, 2015, via Internet Archive: Wayback Machine URL <https://hub.globalccsinstitute.com/publications/hazard-analysis-offshore-carbon-capture-platforms-and-offshore-pipelines/21-properties-co2>, 12 pages.

Jensen, "Thermally induced hydraulic fracturing of cold water injectors," WPC-26154, 14th World Petroleum Congress, May 29-Jun. 1, 1994, 2 pages.

Masa and Kuba, "Efficient use of compressed air for dry ice blasting," Journal of Cleaner Production, vol. 111, Part A, Jan. 2016, 9 pages.

Mueller et al., "Stimulation of Tight Gas Reservoir using coupled Hydraulic and CO2 Cold-frac Technology," SPE 160365, presented at the SPE Asia Pacific Oil and Gas Conference and Exhibition, Oct. 22-24, 2012, 7 pages.

Praxair, "Carbon Dioxide, Solid or Dry Ice, Safety Data Sheet P-4575," Praxair, Jan. 1, 1997, 7 pages.

princeton.edu [online], "Bernoulli's Equation," available on or before Jul. 24, 1997, via Internet Archive: Wayback Machine URL <https://www.princeton.edu/~asmits/Bicycle_web/Bernoulli.html>, 5 pages.

Schlumberger Oilfield Glosary, "Underbalance," retrieved on Apr. 12, 2019, retrieved from URL http://www.glossary.oilfield.slb.com/Terms/u/underbalance.aspx, 1 pages.

Soreide et al., "Estimation of reservoir stress effects due to injection of cold fluids: an example from NCS," ARMA 14-7394, presented at the 48th US Rock mechanics/Geomechanics Symposium, Jun. 1-4, 2014, 7 pages.

Weinstein, "Cold Waterflooding a Warm Reservoir," SPE 5083, presented at the 49th Annual Fall Meeting of the Society of Petroleum Engineers of AIME, Oct. 6-9, 1974, 16 pages.

Yu et al., "Chemical and Thermal Effects on Wellbore Stability of Shale Formations," SPE 71366, presented at the 2001 SPE Annual Technical Conference and Exhibition, Sep. 30-Oct. 3, 2001, 11 pages.

GCC Examination Report in GCC Appln. No. GC 2018-35840, dated Mar. 24, 2020, 4 pages.

* cited by examiner

RAPIDLY COOLING A GEOLOGIC FORMATION IN WHICH A WELLBORE IS FORMED

CROSS-REFERENCE TO RELATED APPLICATIONS

This application claims the benefit of priority to U.S. Utility Patent application Ser. No. 16/059,748, filed Aug. 9, 2018 and entitled "RAPIDLY COOLING A GEOLOGIC FORMATION IN WHICH A WELLBORE IS FORMED," which claims the benefit of priority to U.S. Provisional Patent Application Serial No. 62/545,690, filed Aug. 15, 2017 and entitled "RAPIDLY COOLING A GEOLOGIC FORMATION IN WHICH A WELLBORE IS FORMED," the contents of both which are hereby incorporated by reference.

TECHNICAL FIELD

This disclosure relates to wellbore interventions and completions.

BACKGROUND

In hydrocarbon production, a wellbore is formed into a geologic formation. In some instances, rock within the geologic formation adjacent to the wellbore can be fractured by pumping high-pressure fluids into the wellbore. Fracturing the geologic formation can increase production rates.

SUMMARY

This disclosure describes technologies relating to rapidly cooling a wellbore.

An example implementation of the subject matter described within this disclosure is a wellbore tool with the following features. A first chamber is configured to be positioned within a wellbore. The first chamber includes a cooling fluid. A second chamber is positioned uphole of the first chamber. The first chamber and the second chamber are configured to be lowered to a position within the wellbore. The second chamber includes a cold source at a sub-zero temperature. The cooling fluid is configured to be cooled upon contacting the cold source. A separation member is positioned between the first chamber and second chamber. The separation member separates the cooling fluid and the cold source. An activation device is connected to the separation member. The activation device is configured to cause the separation member to allow the cold source to contact the cooling fluid.

Aspects of the example implementation, which can be combined with the example implementation alone or in combination, include the following. The second chamber is vacuum insulated.

Aspects of the example implementation, which can be combined with the example implementation alone or in combination, include the following. The cooling fluid includes at least one of ethylene glycol, isopropyl alcohol, water, xylene, acetone, or isopropyl ether.

Aspects of the example implementation, which can be combined with the example implementation alone or in combination, include the following. The cold source comprises dry ice.

Aspects of the example implementation, which can be combined with the example implementation alone or in combination, include the following. The dry ice comprises dry ice pellets.

Aspects of the example implementation, which can be combined with the example implementation alone or in combination, include the following. The wellbore tool is configured to be lowered into a wellbore with an e-line.

Aspects of the example implementation, which can be combined with the example implementation alone or in combination, include the following. The cooling fluid and the cold source, upon contacting each other, are configured to lower a temperature within a wellbore at a target depth to substantially −77° C.

Aspects of the example implementation, which can be combined with the example implementation alone or in combination, include the following. The separation member includes a diaphragm configured to rupture upon activation of the wellbore tool.

Aspects of the example implementation, which can be combines with the example implementation alone or in combination, include the following. The activation device includes a sparking mechanism and a detonation mechanism that detonates in response to the activation of the sparking mechanism.

Aspects of the example implementation, which can be combined with the example implementation alone or in combination, include the following. The sparking mechanism includes an electric sparking mechanism.

An example implementation of the subject matter described within this disclosure is a method with the following features. A first chamber that includes a cooling fluid is positioned downhole relative to a second chamber that includes a cold source at a first sub-zero temperature. The cooling fluid is configured to be cooled upon contacting the cold source. The cold source is separated from the cooling fluid by a separation member. The first chamber and the second chamber are lowered to a position within a wellbore formed in a formation. The cold source is caused to contact the cooling fluid by activating the separation member. A combination of the cold source and the cooling fluid cools to a second sub-zero temperature at least a portion of the combination is transferred to the formation at the position.

Aspects of the example method, which can be combined with the example method alone or in combination, include the following. fracturing operations are performed on the wellbore after transferring at least a portion of the combination to the formation at the position.

Aspects of the example method, which can be combined with the example method alone or in combination, include the following. A necessary fracturing pressure is lowered in response to cooling the wellbore.

Aspects of the example method, which can be combined with the example method alone or in combination, include the following. The cooling fluid and the cold source, upon contacting each other, are configured to lower a temperature within a wellbore at a target depth to substantially −77° C.

Aspects of the example method, which can be combined with the example method alone or in combination, include the following. The cooling fluid includes at least one of ethylene glycol, isopropyl alcohol, water, xylene, acetone, or isopropyl ether.

Aspects of the example method, which can be combined with the example method alone or in combination, include the following. Causing the cold source to contact the cooling fluid includes rupturing a ceramic disc.

An example implementation of the subject matter described within this disclosure is a system with the following features. A canister is configured to be positioned at a downhole location within a wellbore. The canister includes a cold source at a first sub-zero temperature, a cooling fluid configured to be cooled to a second sub-zero temperature in response to being contacted by the cold source, a separation device that prevents the cold source from contacting the cooling fluid, and an activation mechanism connected to the canister. In response to a signal, the activation mechanism is configured to cause the separation device to permit the cold source to contact the cooling fluid and transfer at least a portion of a combination of the cold source and the cooling fluid to a wellbore wall at the downhole location.

Aspects of the example system, which can be combined with the example system alone or in combination, include the following. The cooling fluid includes at least one of ethylene glycol, isopropyl alcohol, water, xylene, acetone, or isopropyl ether.

Aspects of the example system, which can be combined with the example system alone or in combination, include the following. The cold source comprises dry ice pellets.

Aspects of the example system, which can be combined with the example system alone or in combination, include the following. The separation device includes a ceramic disc configured to rupture by the activation mechanism.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

When fracturing a wellbore formed in a geologic formation, high pressure fluid is injected into the wellbore at a target location. In some instances, the necessary injection pressure to fully fracture the formation for production can be too high for the wellbore to remain stable. That is, the wellbore can collapse, deform, or become otherwise damaged by the fracturing pressure. In such an instance, it can be useful to reduce the necessary fracture pressure to both increase production rates and maintain wellbore stability This disclosure describes lowering a necessary injection pressure of a geologic formation from within a wellbore by rapidly cooling the walls of the wellbore using a cold source and a cooling fluid, such as dry ice and isopropyl alcohol, respectively. A two-chambered canister is lowered into the wellbore to a target depth, for example, in line with perforations already formed within the wellbore. The lower chamber in the canister contains a cooling fluid, for example, isopropyl alcohol or a similar chemical, while the upper chamber contains a cold source, such as dry-ice or a similar cold source. The upper chamber includes the necessary insulation and sealing to maintain dry-ice in its solid form as it travels downhole. In some implementations, the chamber contains partially sublimated dry ice, increasing the pressure within the chamber to at least partially facilitate moving the solid dry ice towards the cooling fluid. To cool the formation, the dry-ice is dropped into the isopropyl alcohol. The mixture is released from the canister by rupturing diaphragms along the side of the canister. The resulting expansion from sublimation rapidly cools the wellbore. Such cooling lowers the necessary fracture pressure of the formation as the lower temperature makes the rock brittle.

Figure 1:
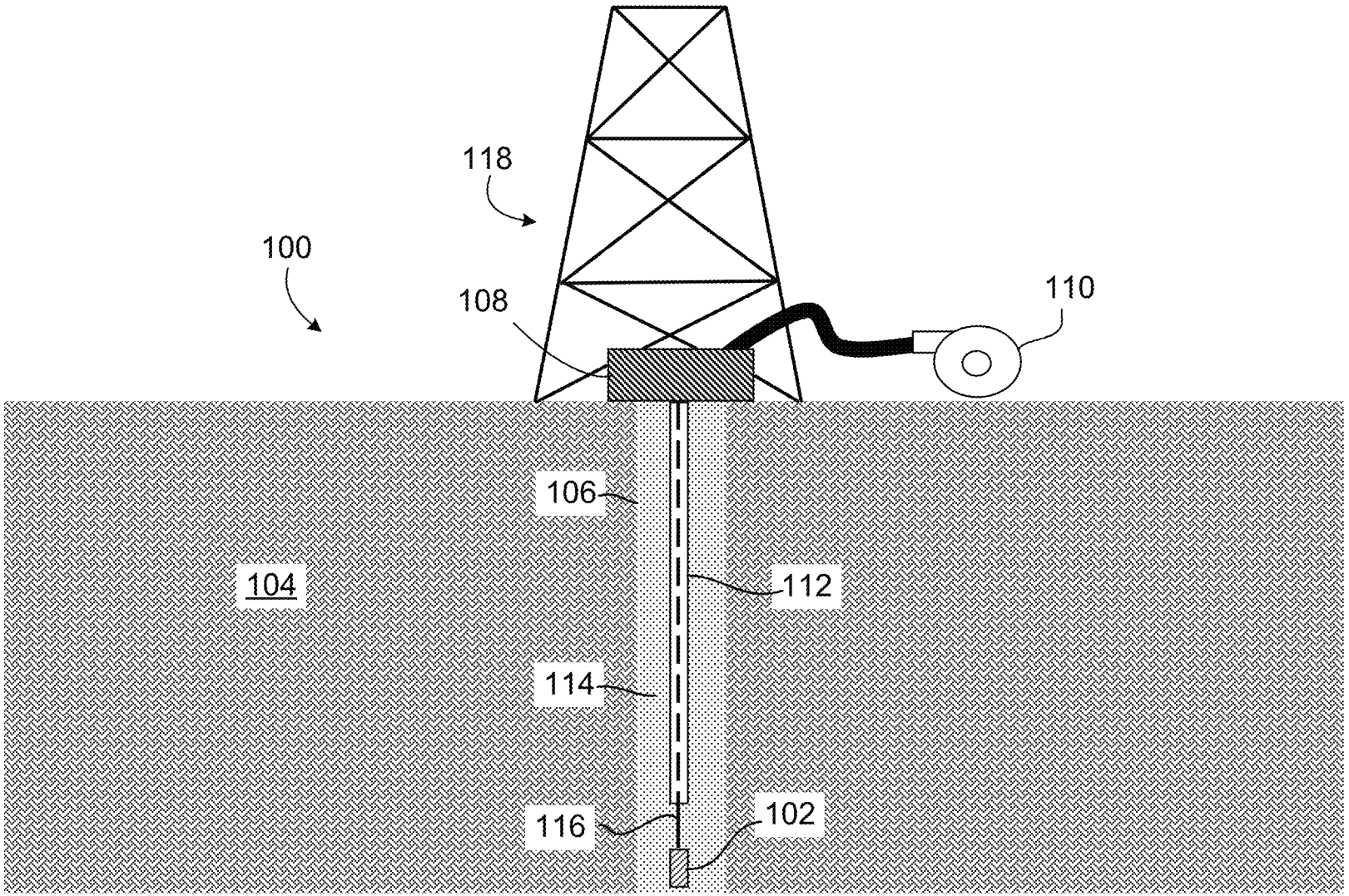
FIG. 1 is a schematic diagram showing a side view of an example wellbore intervention and completion system.

FIG. 1 shows an example of a wellbore intervention and completion system 100 capable of rapidly cooling a target area of the wellbore 106. In the illustrated implementation, the system 100 includes a derrick 118 that is capable of supporting any equipment lowered into the wellbore 106. The wellbore 106 has previously been formed within the geologic formation 104. Atop the wellbore sits a well head and blow-out preventer 108 that separates the wellbore from a topside facility. The system 100 also includes a pump 110 that is capable of pumping fluid at a sufficient pressure to fracture the formation. The system includes a canister 102 that is designed to be lowered into the wellbore 106 to a target depth prior to fracturing the geologic formation. The canister can be lowered by an e-line 116, coiled tubing, or a pipe string. In some implementations, the wellbore 106 can include either a production string, well liner, or well casing 112. In such implementations, the canister 102 is lowered to a target location within a wellbore through the production string, well liner, or well casing 112. While the illustrated implementation includes a derrick, other implementations can be utilized with far less infrastructure, for example, a coiled tubing truck with a lubricator can be utilized.

Figure 2B:
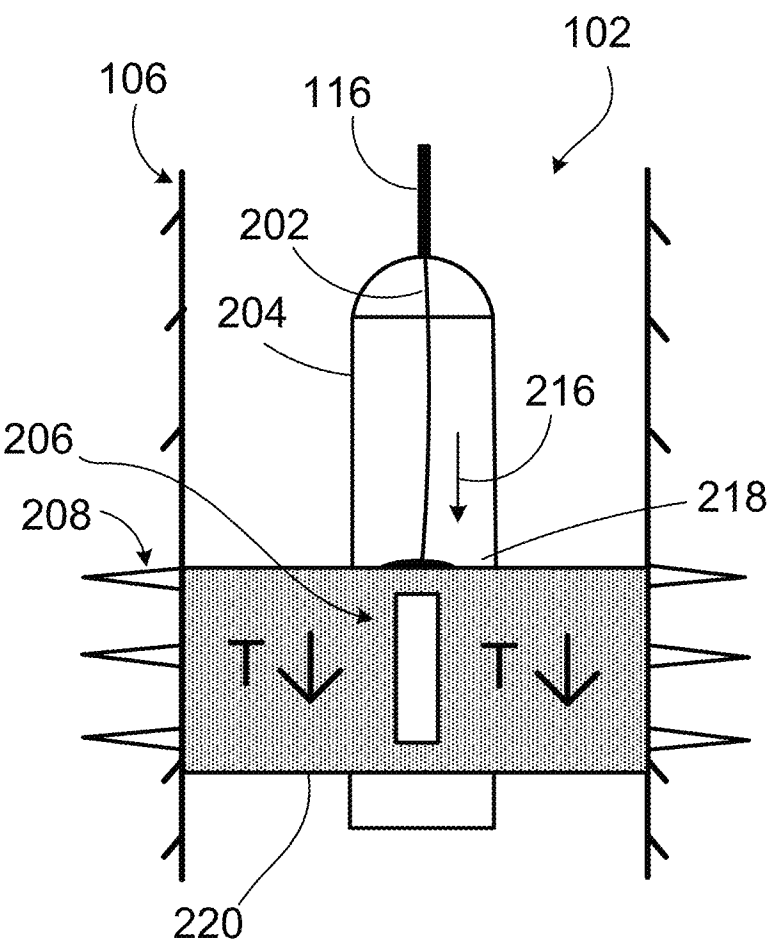
FIGS. 2A-2B are schematic diagrams of an example canister in a deactivated state and an activated state respectively.
Figure 2A:
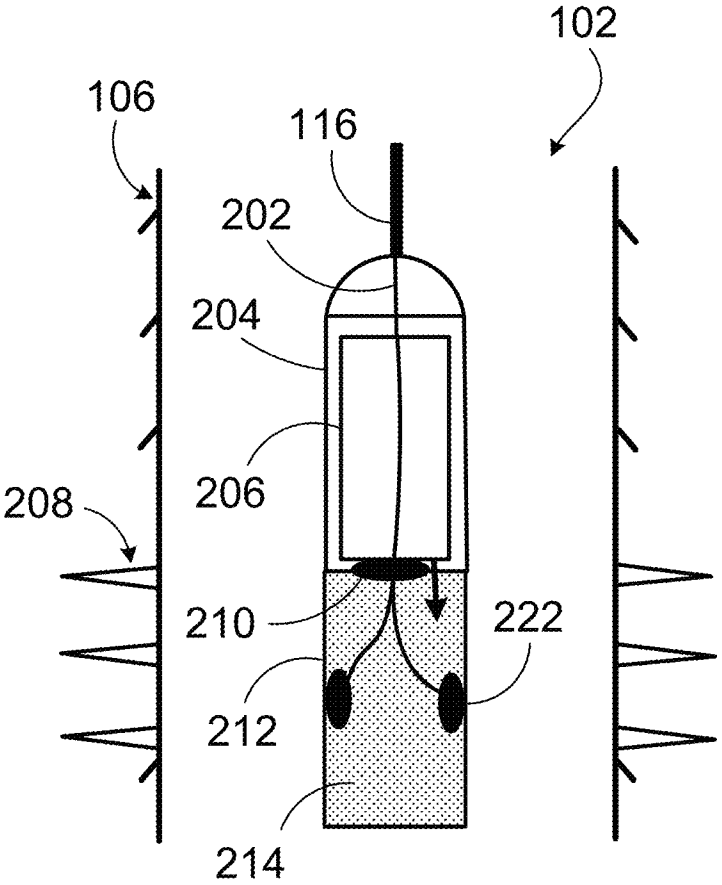

FIG. 2A shows a detailed cross sectional view of the canister 102. The canister 102 includes a first chamber 212 that is capable of containing a cooling fluid 214. The cooling fluid 214 can include at least one of ethylene glycol, isopropyl alcohol, water, xylene, acetone, or isopropyl ether, or any other fluid with sufficient properties to cool the wellbore. A second chamber 204 is positioned uphole of the first chamber 212. While this disclosure discusses the use of a single canister with multiple chambers, multiple, separate canisters can be used to similar effect. The first chamber 212 and the second chamber 204 are capable of being lowered to the target position within the wellbore. In the illustrated implementation, the canister 102 has been lowered to a position adjacent to a set of perforations 208. The second chamber 204 includes a cold source 206 at a sub-zero (° C.) temperature. In some implementations, the cold source can include a single, large piece of dry ice, dry ice pellets, or any other sufficiently cold solid. In some implementations, the cold source can sublimate and expand to further the cooling effects of the canister 102 due to the heat required for the phase change of the cold source. The second chamber 204 has sufficient insulation to keep the cold source 206 at a desired temperature. For example, the second chamber 204 can be vacuum insulated.

The cold source 206 and the cooling fluid 214 are initially separated by a separation member 210 positioned between the first chamber 212 and second chamber 204. In some implementations, the separation member 210 can include a ceramic disc configured to be ruptured by the activation mechanism. Though a ceramic disc is described as the separation member in this disclosure, any mechanism that can be ruptured or opened can be used, for example, a metal rupture disc, an elastomer membrane, or any other breakable membrane. In some implementations, a hydraulic or electric solenoid valve can be used. In some implementations, an electromechanical door can be used.

An activation device is connected to the separation member. The activation device is designed to cause the separation member to allow the cold source to contact the cooling fluid when triggered. For example, the activation device can include a sparking mechanism 202 and a detonation mechanism that detonates in response to the activation of the sparking mechanism 202. The sparking mechanism can be powered by an electric line from the surface, can be mechanically triggered by striking a piezoelectric material, or produced by any other technique to produce a spark. The detonation mechanism can rupture the separation member and allows the cold source 206 and the cooling fluid 214 to be mixed. For example, a ceramic disc can be shattered by the detonation mechanism to allow the cold source 206 to drop in a downward direction 216 into the cooling fluid 214 to mix. While a dropping mechanism is described to mix the cold source 206 and the cooling fluid 214, other mixing mechanics can be utilized without departing from this disclosure. For example, a pump can be used to pump the cooling fluid 214 into the second chamber 204 to come in contact with the cold source 206. The cooling fluid 214 is cooled upon contacting the cold source 206. Once the cold source 206 and cooling fluid 214 are mixed, the mixture 220 (or simply the chilled cooling liquid) is released from the canister through a set of diaphragms 222, that can be activated by the same activation mechanism, and comes into contact with the walls of the wellbore 106. In some implementations, a separate, second activation mechanism can be used.

FIG. 2B shows the canister 102 after it has been activated. The separation member 210 includes a diaphragm that ruptures upon activation of the canister 102. Once activated, the cold source 206 and the cooling fluid 214 come in contact with one another. Once the cooling fluid 214 and the cold source 206 contact one another, the mixture 220 is released by rupturing the diaphragms 222 into the wellbore 106 and lowers a temperature within the wellbore 106 to substantially −77° C.

Figure 3:
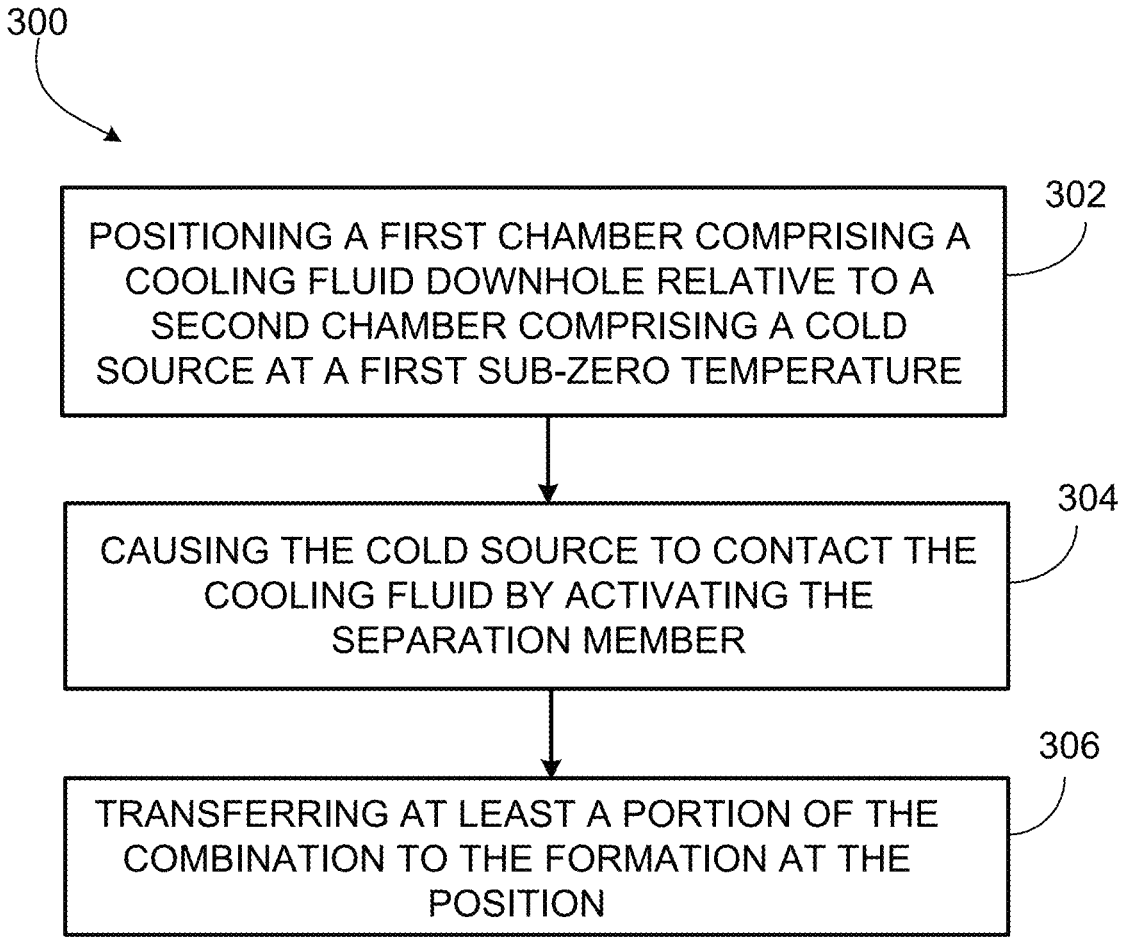
FIG. 3 is a flowchart of an example method that can be used with aspects of this disclosure.

FIG. 3 is a flowchart of an example method that can be used with aspects of this disclosure. At 302, a first chamber that includes a cooling fluid is positioned downhole relative to a second chamber that includes a cold source at a first sub-zero temperature. The cooling fluid is configured to be cooled upon contacting the cold source. The cooling fluid can include at least one of ethylene glycol, isopropyl alcohol, water, xylene, acetone, isopropyl ether, or any other fluid with sufficient properties to cool the wellbore. The cold source is separated from the cooling fluid by a separation member. The first chamber and the second chamber are lowered to a position within a wellbore formed within a formation. In some implementations, the target location can be adjacent to perforations formed in the wellbore 106 prior to lowering the canister 102 into the wellbore 106.

At 304, the cold source is made to contact the cooling fluid by activating the separation member. For example, causing the cold source to contact the cooling fluid can include rupturing a ceramic disc separating the cold source and the cooling fluid, allowing the cold source 206 to drop into the cooling fluid 214 with the aid of gravity. A combination of the cold source and the cooling fluid cools to a second sub-zero temperature. At 306, at least a portion of the combination is transferred to the formation at the target position.

In some implementations, fracturing operations can be performed within the wellbore after transferring at least a portion of the cooling combination to the formation. The cooling operation described within this disclosure lowers a necessary fracturing pressure by making the geologic formation adjacent to the released fluid brittle. For example, the cooling fluid and the cold source, upon contacting each other, can lower a temperature within a wellbore at a target depth to substantially −77° C. In some implementations, the necessary fracture pressure can be significantly lowered.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described program components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A system comprising:

a canister configured to be positioned at a downhole location within a wellbore, the canister comprising:
- a cold source at a first sub-zero temperature;
- a cooling fluid configured to be cooled to a second sub-zero temperature in response to being contacted by the cold source; and
- a separation device that prevents the cold source from contacting the cooling fluid; and
- an activation mechanism connected to the canister, wherein, in response to a signal, the activation mechanism is configured to:
  - cause the separation device to permit the cold source to contact the cooling fluid, and
  - transfer at least a portion of a combination of the cold source and the cooling fluid to a wellbore wall at the downhole location.

2. The system of claim 1, wherein the cooling fluid comprises at least one of ethylene glycol, isopropyl alcohol, water, xylene, acetone, or isopropyl ether.

3. The system of claim 1, wherein the cold source comprises dry ice pellets.

4. The system of claim 1, wherein the separation device comprises a ceramic disc configured to rupture by the activation mechanism.

* * * * *